United States Patent [19]

Weisz

[11] 4,434,733

[45] Mar. 6, 1984

[54] BIGHT AND NEEDLE POSITIONING CONTROL FOR SEWING MACHINES

[75] Inventor: William Weisz, Tenafly, N.J.

[73] Assignee: The Singer Company, Stamford, Conn.

[21] Appl. No.: 461,826

[22] Filed: Jan. 28, 1983

[51] Int. Cl.[3] ..... D05B 3/02

[52] U.S. Cl. ..... 112/158 A

[58] Field of Search ..... 112/158 A, 158 B, 158 D

[56] References Cited

U.S. PATENT DOCUMENTS 2,682,845 7/1954 Robert et al. .
3,041,988 7/1962 Fujita .
3,247,817 4/1966 Eguchi .
3,753,411 8/1973 Graham et al. ..... 112/158 A
3,766,871 10/1973 Mastuda et al. ..... 112/158 A

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A control for a sewing machine is arranged to enable an operator, utilizing a single input control member, to select the amplitude of side to side motion of a needle bar for pattern sewing, or to dispose the needle bar in defined off-center positions for either straight stitch sewing or for effecting disengagement of the needle bar from driving mechanism.

9 Claims, 6 Drawing Figures

42
70
71
62
66
40
38
52
98
58
60
57
84
54
52
86
10
82
90
92
56
100
102
94
26
78
22
80
28
98
114
76
104
106
108
96
110
112
36
28
24
34
16
30
32
34
20
32
14
12
32
18

BIGHT AND NEEDLE POSITIONING CONTROL FOR SEWING MACHINES

BACKGROUND OF THE INVENTION

1. Field of the Invention

The invention relates to bight and needle positioning controls for sewing machines.

2. Description of the Prior Art

It is well known to provide a sewing machine with a bight control enabling an operator to select the amplitude of side to side motion of a needle bar for pattern sewing, and to further provide other control means enabling the operator to dispose the needle bar in a right or left of center position.

A prime object of the present invention is the provision of an improved control arrangement for a sewing machine enabling an operator utilizing a single input control member to select not only what the bight of a needle bar shall be for pattern sewing, but also to dispose the needle bar in either of alternate side positions for straight stitch sewing, or in an extreme side position for effecting disengagement of the needle bar from a drive therefor.

Other objects and advantages of the invention will become apparent during a reading of the specification taken in connection with the accompanying drawings.

SUMMARY OF THE INVENTION

A pivoted member movable according to a selected pattern to be sewn on a machine is operably connected to linkage means for imparting side to side motion to a needle bar. The operable connection between the pivoted member and linkage means includes a slot in one, and a pin on the other adjustable within the slot for changing the amplitude of side to side movement of the needle bar in response to movement of the pivoted member. The slot includes enlarged end portions where the pin may be disposed to disengage the linkage means and pivoted member. Fixed structure engages the pin while in the enlarged end portions of the slot and defines particular off-center positions for the needle bar. The pin is positionable within the slot by an input member provided for use by an operator.

DESCRIPTION OF THE PREFERRED EMBODIMENT

Figure 1:
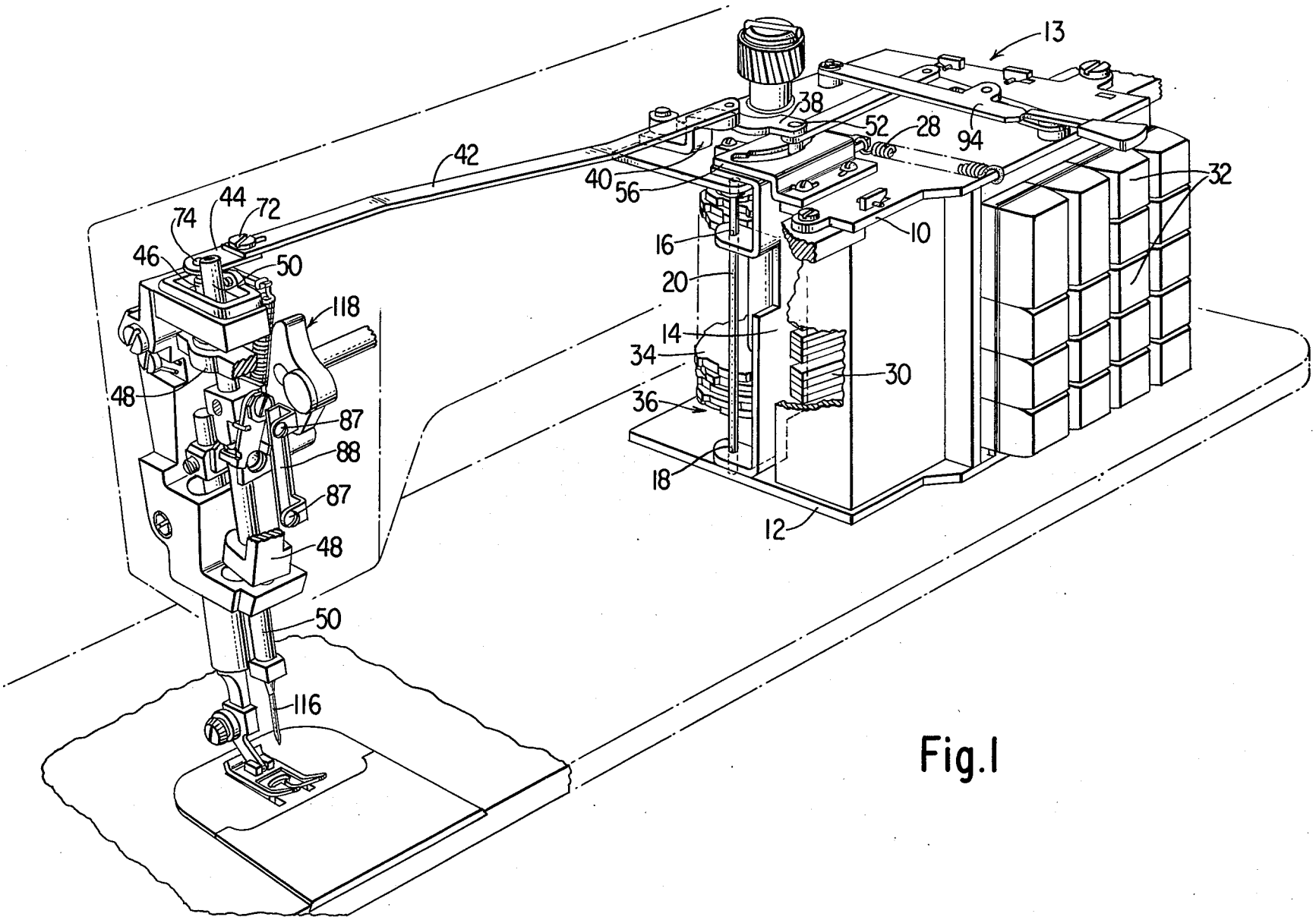
FIG. 1 is a perspective view showing a bight and needle positioning control including mechanism according to the invention.
Figure 2:
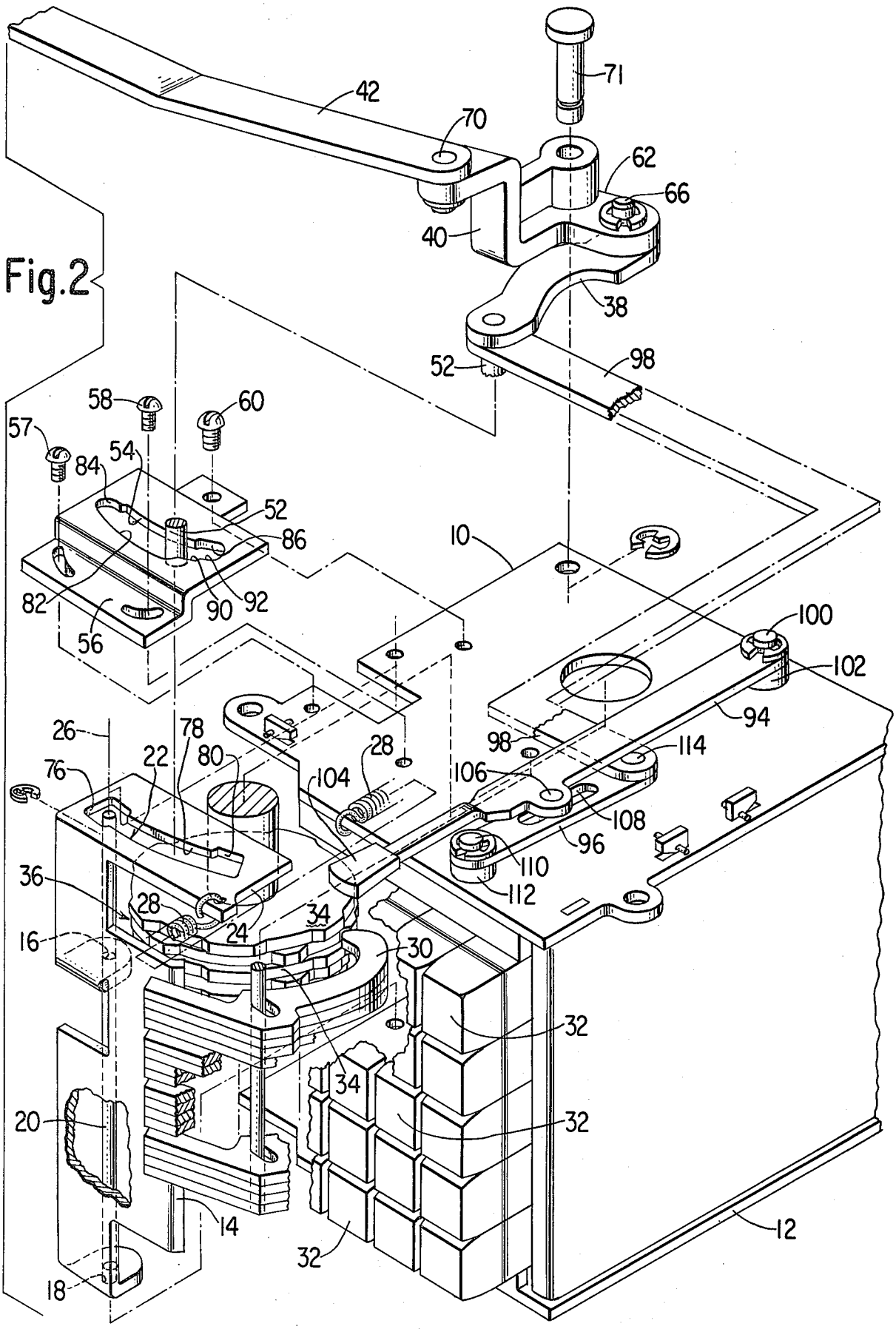
FIG. 2 is an enlarged exploaded perspective view showing said mechanism.

Referring to the drawings, reference characters 10 and 12 designate the top and bottom plates, respectively, of a control module 13 of the kind disclosed in the copending application of W. Weisz for "Push-Button Control Module for Sewing Machine", Ser. No. 449,721, filed Dec. 14, 1982. As shown, a member 14 is pivotally mounted at 16 and 18 on a shaft 20, which is affixed at the ends of the plate. Such member includes a slot 22, in an arm 24, which overlies top plate 10 and extends perpendicularly with respect to the pivotal axis 26 of the member. Member 14 is pivotally movable against the bias of a spring 28 in a predetermined manner by any one of a plurality of cam followers 30 when caused by suitable pattern selecting means 32 as in the manner described in said patent application of W. Weisz, to effectively engage both an associated cam 34, in a cam stack 36 and the member 14.

Linkage means including a link 38, a bell crank 40, and a link 42 with an adjustable extension 44 are provided to operably connect member 14 with a needle bar post 46. A gate 48 and needle bar 50 are laterally movable, in a manner well known, by the post 46. A pin 52, at one end of link 38, serves to operably connect the link with member 14. The pin 52 extends into slot 22 in member 14 after first passing through an aligned slot 54 in a bracket 56 which extends over arm 24 and is affixed to top plate 10 with screws 57, 58 and 60. Link 38 is connected at the opposite end from pin 52 to an arm 62 of bell crank 40 by a pin 66. The bell crank is pivotally connected at 70 to one end of link 42, and is movable about a pin 71 in plate 10. The opposite end of link 42 is connected by a screw 72 to adjustable extension 44, and the adjustable extension is pivotally connected at 74 to needle post 46.

The pivotal axis 26, of member 14, passes through slot 22 at the junction of an enlarged end portion 76 of the slot and an intermediate portion 78 connecting the enlarged end portion 76 with an opposite end enlarged portion 80. Slot 54, in bracket 56, includes an intermediate portion 82, which is directly above and is wider than intermediate portion 78 of slot 22. One end of slot 54 is formed with a pin receiving and confining narrowed end portion 84 which directly overlies and is less in width than enlarged end portion 76 of slot 22. The opposite end of slot 54 is formed with pin receiving and confining first and second narrowed end portions 86 and 88, which directly overlie and are less in width than enlarged end portion 80 of slot 22. Slot 54 is formed with a ramp 90 for leading pin 52 into end portion 84, and with ramps 92 and 93 for leading the pin into end portions 86 and 88 respectively.

A linkage arrangement, including a lever 94 and links 96 and 98, is provided for positioning pin 52 on link 38 in slots 22 and 54. Lever 94 is pivotally mounted at one end on a pin 100 extending from a boss 102 which is affixed in plate 10. An opposite end 104 of lever 94 is free and fashioned for manipulation by an operator. A pin 106 extending from the lever 94 at an intermediate location registers in a slot 108 in link 96 to operably connect the lever with link 96. One end of link 96 is pivotally mounted on a pin 110 projecting from a boss 112 affixed in plate 10 and the opposite end is pivotally connected by a pin 114 to one end of link 98. The opposite end of link 98 is connected to pin 52 for pivotal movement thereon.

Figure 3:
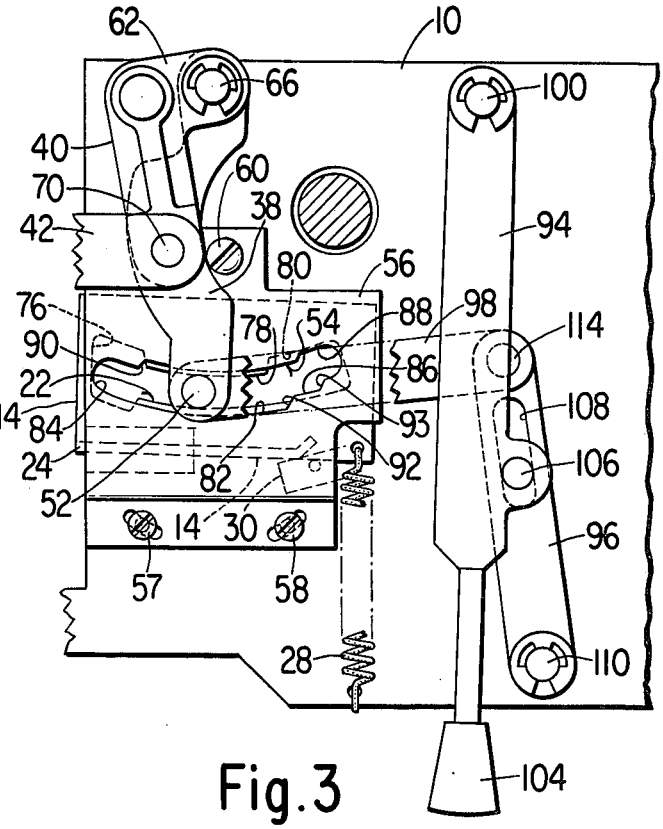

Pin 52 is positionable in slots 22 and 54 with lever 94 acting through links 96 and 98. For any position of pin 52 in the intermediate portion 78 of slot 22 (FIG. 3), the pin is rocked by member 14 about axis 26 in response to pivotal movement of the member as determined by a selected follower 30 and actuating cam 34. Pin 52 acting through link 38, bell crank 40, link 42 and extension 44 imparts side to side motion to needle bar 50, and a needle 116 carried by the needle bar is thereby enabled to sew a pattern as the needle bar is vertically reciprocated by driving mechanism 118. The amplitude of the side to side motion (bight) of needle 116 may be increased by disposing pin 52 with lever 94 in slot portion 78 to increase the distance of the pin from axis 26, and may be decreased by disposing the pin to decrease the distance of the pin from said axis. Regardless of the position of pin 52 in slot portion 78, the pin while moved by member 14 remains out of contact with the sides of slot 54 in bracket 56 because of the greater width of the intermediate portion 82 of slot 54 as compared to the width of intermediate portion 78 of slot 22, and the limited movement of which member 14 is capable as predetermined by the cams 34.

The intermediate portion 78 of slot 22 is a circular track with a radius corresponding to the distance between pins 52 and 66 at the opposite ends of link 38, and while the needle bar is in a central position, pin 52 can be positioned by lever 94 along with pivotal movement of link 38 about pin 66 without disturbing the needle bar. By locating pin 52 with lever 94 in slot 22 beyond slot portion 78, pin 52 is disengaged from member 14 and the needle bar is caused to assume a left or right of center position.

Figure 4:
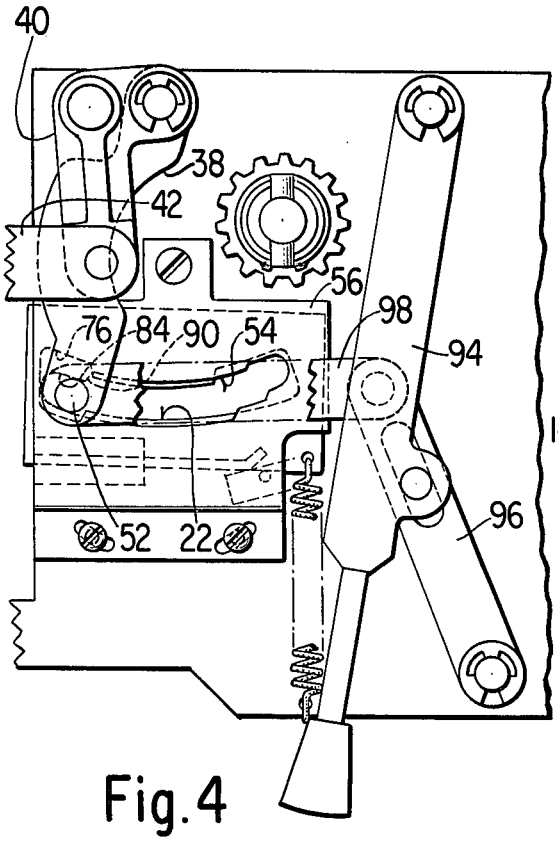
FIGS. 3, 4, 5 and 6 are top plan views showing the mechanism of the invention in various control positions.

When pin 52 is moved with lever 94 to the left of intermediate portion 78 and 82 in slots 22 and 54 respectively, the pin passes into enlarged end portion 76 of slot 22 wherein the pin is disengaged from member 14. At the same time, pin 52 is moved downwardly by way of ramp 90 into narrowed end portion 84 of slot 54 (FIG. 4), and in so doing acts through link 38, bell crank 40, link 42 and extension 44, to thereby move the needle bar 50 at extension 44 to the left, as viewed in FIG. 1. End portion 84 of slot 54 defines a particular left of center, straight stitching, position for the needle bar.

Figure 5:
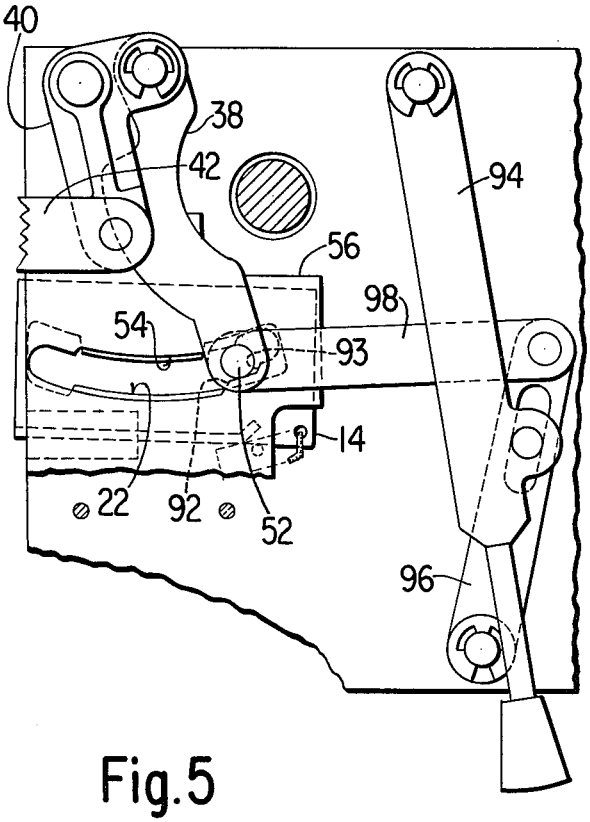
Figure 6:
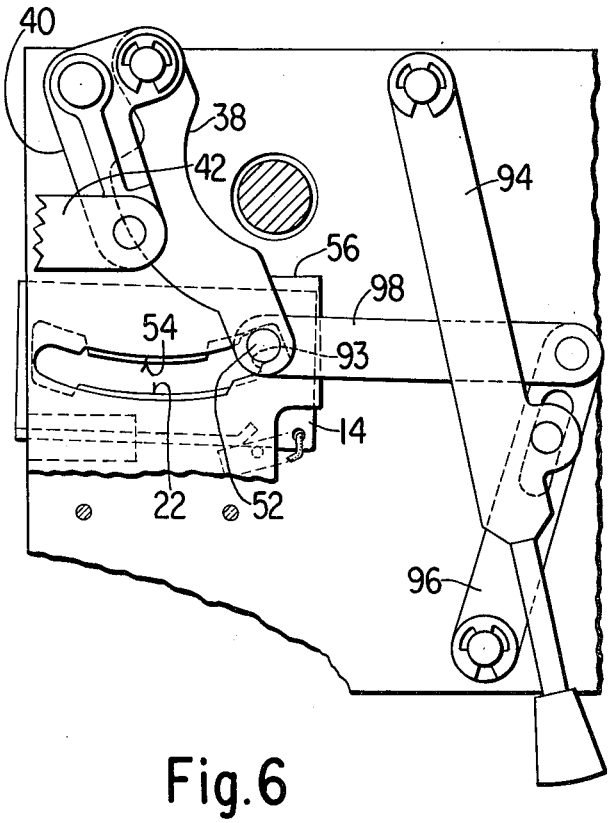

When pin 52 is moved with lever 94 to the right of intermediate portions 78 and 82 in slots 52 and 54, the pin passes into enlarged end portion 80 of slot 22 and is disengaged from member 14. The pin is then also moved over ramp 92 up into first narrowed end portion 86 of slot 54 (FIG. 5), or over ramps 92 and 93 up into second narrowed end portion 88 of the slot depending upon the extent of movement of lever 94 (FIG. 6). The pin then acts through link 38, bell crank 40, link 42 and extension 44, and thereby causes needle bar 50 at extension 44 to be moved to the right. First narrowed end portion 86 of slot 54 defines a particular right of center, straight stitch portion for the needle bar, and second narrowed end portion 88 of the slot defines a further right of center needle bar position wherein the needle bar is disconnected from the driving mechanism 118 as in the manner described in U.S. Pat. No. 3,782,311 of Kenneth D. Adams et al for "Simplified Basting Stitch Mechanism", issued Jan. 1, 1974.

It is to be understood that the present disclosure relates to a preferred embodiment of the invention which is for purposes of illustration only, and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. Bight controlling and needle positioning mechanism for a sewing machine including a pivoted member; means for predetermining pivotal movement of said member according to a desired pattern to be produced on the machine; linkage means operably connected to the pivoted member for imparting side to side movement to a needle bar; the operable connection between the linkage means and said pivoted member including a pin, and including a slot wherein the pin is adjustable for changing the amplitude of side to side movement of the needle bar in response to movement of the pivoted member, the slot including an enlarged one end portion where the pin may be disposed to disengage the linkage means and pivoted member; means for confining the pin in said enlarged one end portion of the slot to thereby define a particular side position of the needle bar; and means movable by an operator for positioning the pin in said slot.

2. Bight controlling and needle positioning mechanism according to claim 1 wherein the slot is in the pivoted member and the pin is carried by the linkage means.

3. Bight controlling and needle positioning mechanism according to claim 2 wherein the slot is in a plane perpendicular to the axis of the pivoted member.

4. Bight controlling and needle positioning mechanism according to claim 2 wherein the pin confining means is a portion of a pin receiving slot in a fixed bracket.

5. Bight controlling and needle positioning mechanism according to claim 2 wherein the slot in the pivoted member includes an enlarged portion in an opposite end part of the slot from the enlarged one end portion, said mechanism further including means for confining the pin while in the enlarged opposite end part of the slot to thereby define a side position for the needle bar widely spaced from the said particular side position.

6. Bight controlling and needle positioning mechanism according to claim 5 wherein each pin confining means is different portion of a pin receiving slot in a fixed bracket.

7. Bight controlling and needle positioning mechanism according to claim 5 including means for confining the pin, while in one of the enlarged end parts of the slot, in a different position from that in which the pin may be confined by either of the other pin confining means to thereby define an extreme side position for the needle bar.

8. Bight controlling and needle positioning mechanism according to claim 7 wherein each of the pin confining means is a portion of a slot in a fixed bracket.

9. Bight controlling and needle positioning mechanism according to claim 8 wherein the slot in the pivoted member is in a plane perpendicular to the axis of the pivoted member, and the fixed bracket extends above said slot to align the slot in the bracket with the slot in the pivoted member.

* * * * *